US012723575B2

(12) United States Patent
Nishida et al.

(10) Patent No.: US 12,723,575 B2
(45) Date of Patent: Sep. 1, 2026

(54) ROTARY SWASH PLATE HYDRAULIC PUMP

(71) Applicant: KAWASAKI JUKOGYO KABUSHIKI KAISHA, Kobe (JP)

(72) Inventors: Shinji Nishida, Kobe (JP); Isamu Yoshimura, Kobe (JP); Daisuke Nakai, Kobe (JP); Satoru Takao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 18/852,373

(22) PCT Filed: Feb. 3, 2023

(86) PCT No.: PCT/JP2023/003560
§ 371 (c)(1),
(2) Date: Sep. 27, 2024

(87) PCT Pub. No.: WO2023/188817
PCT Pub. Date: Oct. 5, 2023

(65) Prior Publication Data

US 2025/0207569 A1 Jun. 26, 2025

(30) Foreign Application Priority Data

Mar. 31, 2022 (JP) ..... 2022-061100

(51) Int. Cl.
*F04B 1/146* (2020.01)
*F04B 1/14* (2020.01)
*F04B 49/16* (2006.01)

(52) U.S. Cl.
CPC ..... *F04B 1/146* (2013.01); *F04B 1/14* (2013.01); *F04B 49/16* (2013.01)

(58) Field of Classification Search
CPC ..... F04B 1/14–188; F04B 1/26–295; F04B 1/34; F04B 1/16; F04B 1/22; F04B 1/122; F04B 1/246; F04B 49/16
See application file for complete search history.

(56) References Cited

U.S. PATENT DOCUMENTS 2,945,444 A * 7/1960 Leissner ..... F04B 49/18 417/454
3,486,454 A * 12/1969 John ..... F04B 1/295 91/506

(Continued)

FOREIGN PATENT DOCUMENTS

JP H03043687 A 2/1991
JP H1182671 A * 3/1999 ..... F04B 1/2042
JP 2016205266 A 12/2016

*Primary Examiner* — Thomas Fink
(74) *Attorney, Agent, or Firm* — Alleman Hall LLP

(57) ABSTRACT

A hydraulic pump includes a casing; a cylinder block disposed in the casing so as to prevent rotation and including a plurality of cylinder bores that are open on one end surface of the cylinder block; a swash plate rotatably housed in the casing facing the one end surface; a plurality of pistons respectively inserted into the cylinder bores to reciprocate therewithin by rotation of the swash plate; and a variable capacity mechanism that changes an effective stroke length of at least one of the pistons. The mechanism includes a shaft portion inserted through the cylinder block that moves with the swash plate; and a swash plate portion provided on the shaft portion that is movable back and forth in an axial direction and prevents relative rotation of the swash plate portion. The shaft portion is pivotally supported at positions spaced apart in the axial direction in the cylinder block.

6 Claims, 3 Drawing Sheets

(56) References Cited

U.S. PATENT DOCUMENTS

| | | | | |
|---|---|---|---|---|
| 3,873,240 | A * | 3/1975 | Leduc | F04B 1/295<br>417/270 |
| 2006/0024173 | A1* | 2/2006 | Rocchi | F04B 1/145<br>91/499 |
| 2022/0349398 | A1* | 11/2022 | Andras | F04B 49/06 |
| 2023/0400088 | A1* | 12/2023 | Mueller | F16H 37/12 |
| 2024/0102467 | A1* | 3/2024 | Brevini | F04B 1/145 |

* cited by examiner

ROTARY SWASH PLATE HYDRAULIC PUMP

TECHNICAL FIELD

The present invention relates to a rotary swash plate hydraulic pump in which a rotary swash plate is rotated to reciprocate a piston.

BACKGROUND ART

For example, a rotary swash plate piston pump such as that disclosed in Patent Literature (PTL) 1 is known as a piston pump. In the piston pump disclosed in PTL 1, a piston reciprocates when a rotary swash plate rotates. As a result, pressure oil is discharged from the piston pump.

CITATION LIST

Patent Literature

PTL 1: Japanese Laid-Open Patent Application Publication No. 2016-205266

SUMMARY OF INVENTION

Technical Problem

The piston pump disclosed in PTL 1 has a fixed discharge capacity. It is desired that piston pumps have a discharge capacity that can be changed according to circumstances. In view of this, the inventors of the present invention have developed a variable capacity mechanism. The variable capacity mechanism can change the effective stroke length of at least one of a plurality of pistons by rotating a swash plate rotating shaft that moves in conjunction with a rotary swash plate. Meanwhile, a piston pump including the variable capacity mechanism is required to accurately adjust a discharge capacity.

Thus, an object of the present invention is to provide a rotary swash plate hydraulic pump capable of accurately adjusting a discharge capacity.

Solution to Problem

A rotary swash plate hydraulic pump according to the present invention includes: a casing; a cylinder block that is disposed in the casing so as to prevent relative rotation of the cylinder block and including a plurality of cylinder bores that are open on one end surface of the cylinder block; a rotary swash plate rotatably housed in the casing so as to face the one end surface of the cylinder block; a plurality of pistons each of which is inserted into a corresponding one of the plurality of cylinder bores and reciprocates within the corresponding one of the plurality of cylinder bores by rotation of the rotary swash plate; and a variable capacity mechanism that changes an effective stroke length of at least one piston included in the plurality of pistons. The variable capacity mechanism includes: a shaft portion that is inserted through the cylinder block and moves in conjunction with the rotary swash plate; and a swash plate portion provided on the shaft portion so as to be movable back and forth in an axial direction and prevent relative rotation of the swash plate portion. The shaft portion is pivotally supported at positions spaced apart in the axial direction in the cylinder block.

According to the present invention, the shaft portion that rotates in conjunction with the rotary swash plate is pivotally supported at positions spaced apart in the axial direction in the cylinder block. Therefore, the shaft portion is rotated in a stable state. In other words, the swash plate portion provided on the shaft portion so as to prevent rotation thereof is also rotated in a stable state. Since the swash plate portion is rotated in a stable state while being driven to move back and forth in the axial direction, the effective stroke length can be stably adjusted. Therefore, the discharge capacity can be accurately adjusted.

A rotary swash plate hydraulic pump according to the present invention includes: a casing; a cylinder block disposed in the casing so as to prevent relative rotation of the cylinder block and including a plurality of cylinder bores that are open on one end surface of the cylinder block; a rotary swash plate rotatably housed in the casing so as to face the one end surface of the cylinder block; and a plurality of pistons each of which is inserted into a corresponding one of the plurality of cylinder bores and reciprocates within the corresponding one of the plurality of cylinder bores by rotation of the rotary swash plate. The rotary swash plate includes a shaft portion and a swash plate portion that faces the one end surface of the cylinder block. The plurality of pistons reciprocate by rotation of the swash plate portion. The shaft portion is rotatably supported on the casing via a first bearing provided on an exterior of the shaft portion. The swash plate portion is rotatably supported on the casing via a second bearing provided on an exterior of the swash plate portion.

According to this configuration, the rotary swash plate is pivotally supported at two points that are the shaft portion and the swash plate, and thus it is possible to rotate the rotary swash plate in a stable state. Thus, it is possible to keep the rotary swash plate from wobbling. Therefore, the accuracy of the discharge capacity can be improved.

Advantageous Effects of Invention

According to the present invention, it is possible to accurately adjust a discharge capacity.

The above object, other objects, features, and advantages of the present invention will be made clear by the following detailed explanation of preferred embodiments with reference to the attached drawings.

DESCRIPTION OF EMBODIMENTS

Hereinafter, a rotary swash plate hydraulic pump 1 according to an embodiment of the present invention will be described with reference to the aforementioned drawings. Note that the concept of directions mentioned in the following description is used for the sake of explanation; the orientations, etc., of elements according to the invention are not limited to these directions. The hydraulic pump 1 described below is merely one embodiment of the present invention. Thus, the present invention is not limited to the embodiments and may be subject to addition, deletion, and alteration within the scope of the essence of the invention.

<Rotary Swash Plate Hydraulic Pump>

Figure 1:
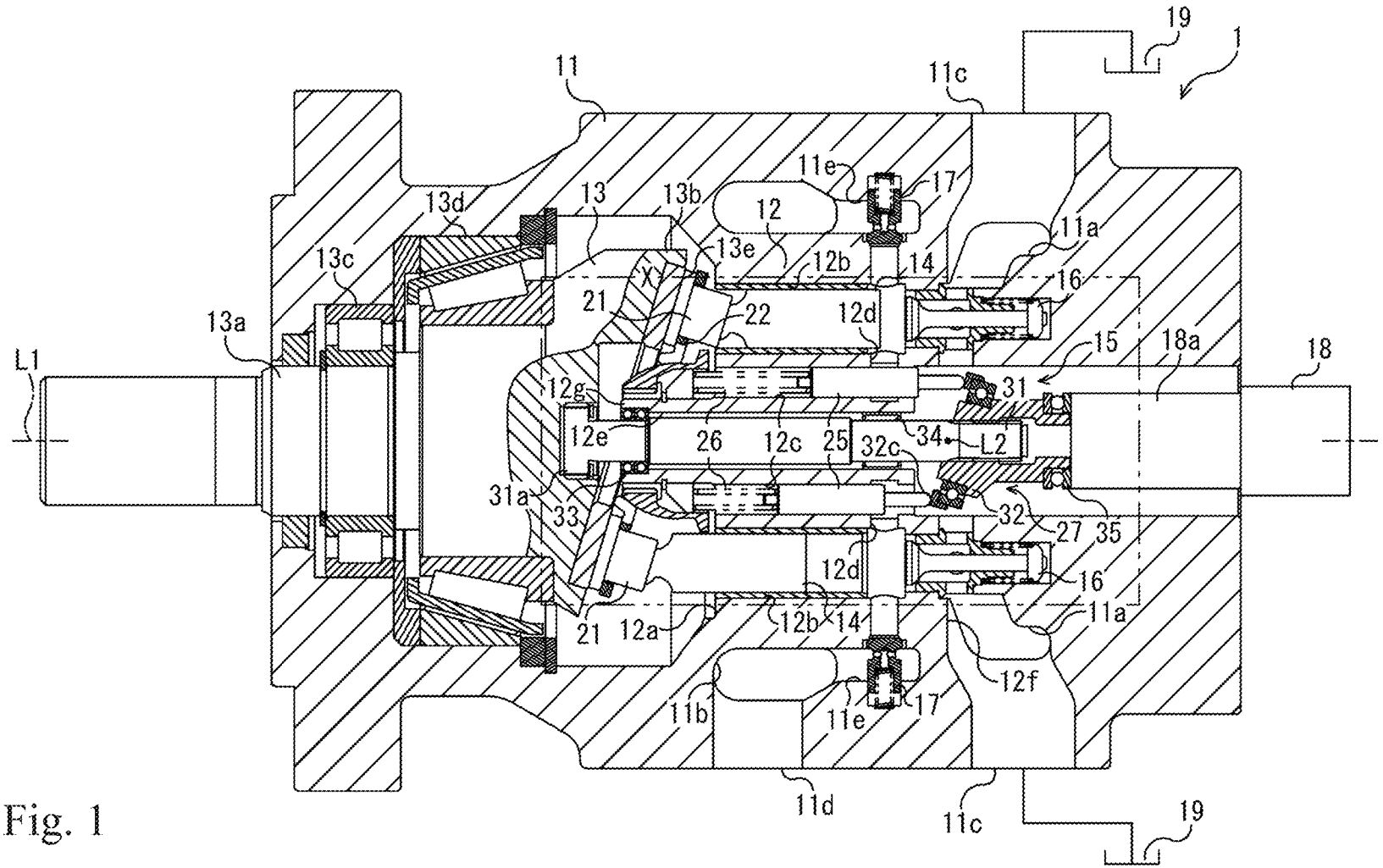
FIG. 1 is a cross-sectional view of a rotary swash plate hydraulic pump according to an embodiment of the present invention.

The rotary swash plate hydraulic pump 1 illustrated in FIG. 1 (hereinafter referred to as "the hydraulic pump 1") is provided in various machines, for example, construction equipment such as an excavator and a crane, industrial equipment such as a forklift, farm equipment such as a tractor, and hydraulic equipment such as a press machine. In the present embodiment, the hydraulic pump 1 is a pump of the rotary swash plate type with a variable capacity. The hydraulic pump 1 includes a casing 11, a cylinder block 12, a rotary swash plate 13, a plurality of pistons 14, and a variable capacity mechanism 15. Furthermore, the hydraulic pump 1 includes a plurality of inlet-end check valves 16, a plurality of discharge-end check valves 17, and a linear motion actuator 18. The hydraulic pump 1 is driven by a drive source (for example, one or both of an engine and an electric motor) to discharge a working fluid.

<Casing>

The casing 11 houses the cylinder block 12, the rotary swash plate 13, the plurality of pistons 14, and the variable capacity mechanism 15. The casing 11 includes an inlet passage 11*a* and a discharge passage 11*b*. The casing 11, which is a cylindrical member, extends along a predetermined axis L1. In other words, the casing 11 is open at one end and the other end that are located on one side and the other side, respectively, in the axial direction.

The inlet passage 11*a* is formed in the other end portion of the casing 11. The inlet passage 11*a* is connected to a plurality of cylinder bores 12*b* of the cylinder block 12, which will be described in detail later. Furthermore, the inlet passage 11*a* is connected to a tank 19 via an inlet port 11*c*. A discharge passage 11*b* is formed in a middle portion of the casing 11. The discharge passage 11*b* is connected to each of the cylinder bores 12*b* of the cylinder block 12, which will be described in detail later. More specifically, the discharge passage 11*b* branches into a plurality of passage portions 11*e* which are connected to side surfaces of the respective cylinder bores 12*b*. Furthermore, a passage portion 11*e* is connected to a hydraulic actuator via a discharge port 11*d*.

<Cylinder Block>

The cylinder block 12 is disposed inside the casing 11 so as to prevent relative rotation thereof. More specifically, the cylinder block 12 is fixed to the casing 11. In the present embodiment, the cylinder block 12 is integrally formed on an axially middle portion of the casing 11. Furthermore, the plurality of cylinder bores 12*b* which are open on one end surface 12*a* are formed in the cylinder block 12. Note that the one end surface 12*a* is an end surface of the cylinder block 12 that is located on one side in the axial direction. Furthermore, a plurality of spool holes 12*c*, a plurality of communication passages 12*d*, and a shaft insertion hole 12*e* are formed in the cylinder block 12. In the cylinder block 12, the number of cylinder bores 12*b* formed and the number of spool holes 12*c* formed are the same. In the present embodiment, nine cylinder bores 12*b* and nine spool holes 12*c* are formed in the cylinder block 12.

The nine cylinder bores 12*b* are arranged circumferentially spaced apart about the axis L1. Each of the cylinder bores 12*b* extends from the one end surface 12*a* to the other end in the axial direction. Each of the cylinder bores 12*b* is open on the one end surface 12*a* and the other end surface 12*f* of the cylinder block 12. Furthermore, each of the cylinder bores 12*b* is connected to the inlet passage 11*a* on the other end surface 12*f* of the cylinder block 12. Moreover, each of the cylinder bores 12*b* is connected to a corresponding one of the passage portions 11*e* of the discharge passage 11*b*.

The nine spool holes 12*c* are arranged circumferentially spaced apart about the axis L1. The nine spool holes 12*c* are positioned radially inward of the nine cylinder bores 12*b*. More specifically, the cylinder block 12 includes, on the one end surface 12*a*, a projection 12*g* extending about the axis L1. The nine spool holes 12*c* are arranged spaced apart from each other about the projection 12*g*. Each of the spool holes 12*c* is associated with a corresponding one of the cylinder bores 12*b*. Each of the spool holes 12*c* is positioned radially inward of the corresponding cylinder bore 12*b*. The nine spool holes 12*c* also penetrate the cylinder block 12 in the axial direction. Furthermore, the nine spool holes 12*c* are connected to the inlet passage 11*a* on the other end surface 12*f* of the cylinder block 12.

Each of the communication passages 12*d* connects one of the cylinder bores 12*b* and a corresponding one of the spool holes 12*c*. Each of the communication passages 12*d* is located on the side of the other end surface 12*f* of the cylinder block 12. Each of the communication passages 12*d* is open on the peripheral surface of one of the cylinder bores 12*b* and the peripheral surface of a corresponding one of the spool holes 12*c*. In the present embodiment, the communication passages 12*d* are positioned radially opposite the passage portions 11*e* of the discharge passage 11*b*. Therefore, the communication passages 12*d* can be easily formed.

The shaft insertion hole 12*e* is formed along the axis L1 in the cylinder block 12. The shaft insertion hole 12*e* penetrates the cylinder block 12 in the axial direction. More specifically, the shaft insertion hole 12*e* penetrates the cylinder block 12 from the leading end surface of the projection 12*g* to the other end surface 12*f* in the axial direction.

<Rotary Swash Plate>

The rotary swash plate 13 includes a shaft portion 13*a* and a swash plate portion 13*b*. The rotary swash plate 13 is rotatably housed in the casing 11 so as to face the one end surface 12*a* of the cylinder block 12. The shaft portion 13*a*, which extends along the axis L1, is rotatably supported on the casing 11. More specifically, the shaft portion 13*a* is provided on the exterior of a first bearing 13*c*. The shaft portion 13*a* is rotatably supported on the casing 11 via the first bearing 13*c*. Thus, the shaft portion 13*a* rotates about the axis L1. The first bearing 13*c*, which is a radial bearing, for example, is a cylindrical roller bearing in the present embodiment. However, the first bearing 13*c* is not limited to the cylindrical roller bearing. The shaft portion 13*a* protrudes from an end surface of the casing 11 that is located on one side in the axial direction, that is, one end of the casing 11. In a portion located on one side in the axial direction, the shaft portion 13*a* is coupled to the drive source mentioned above. The shaft portion 13*a* is rotatably driven by the drive source.

The swash plate portion 13*b* includes a rotary swash plate-end inclined surface 13*e*. The swash plate portion 13*b* is disposed so that the rotary swash plate-end inclined surface 13*e* faces the one end surface 12*a* of the cylinder block 12. The rotary swash plate-end inclined surface 13*e* is tilted toward the one end surface 12*a*. The swash plate portion 13*b* is rotatably supported on the casing 11. More specifically, a second bearing 13*d* is provided on the exterior of the swash plate portion 13*b*. The swash plate portion 13*b* is rotatably supported on the casing 11 via the second bearing 13*d*. Thus, the swash plate portion 13*b* rotates about the axis L1. The second bearing 13*d*, which is a radial bearing, for example, is a tapered roller bearing in the present embodiment. However, the second bearing 13*d* is not limited to the cylindrical roller bearing.

<Piston>

The plurality of pistons 14 are inserted into the corresponding cylinder bores 12*b* of the cylinder block 12. In other words, the same number of pistons 14 as the cylinder bores 12*b* (in the present embodiment, nine pistons 14) are inserted into the cylinder block 12. When the swash plate portion 13*b* of the rotary swash plate 13 rotates, each of the pistons 14 reciprocates within the corresponding cylinder bore 12*b*. More specifically, the nine pistons 14 are in abutment with the rotary swash plate-end inclined surface 13*e*. Therefore, when the rotary swash plate 13 rotates, each of the nine pistons 14 reciprocates within the corresponding cylinder bore 12*b*. Note that the pistons 14 are in abutment with the rotary swash plate-end inclined surface 13*e* of the rotary swash plate 13 via shoes 21 in the present embodiment. Each of the shoes 21 is pressed against the rotary swash plate-end inclined surface 13*e* by a pressing plate 22. Thus, when the rotary swash plate 13 rotates, the pistons 14 reciprocate back and forth in the axial direction via the shoes 21.

<Variable Capacity Mechanism>

Figure 2:
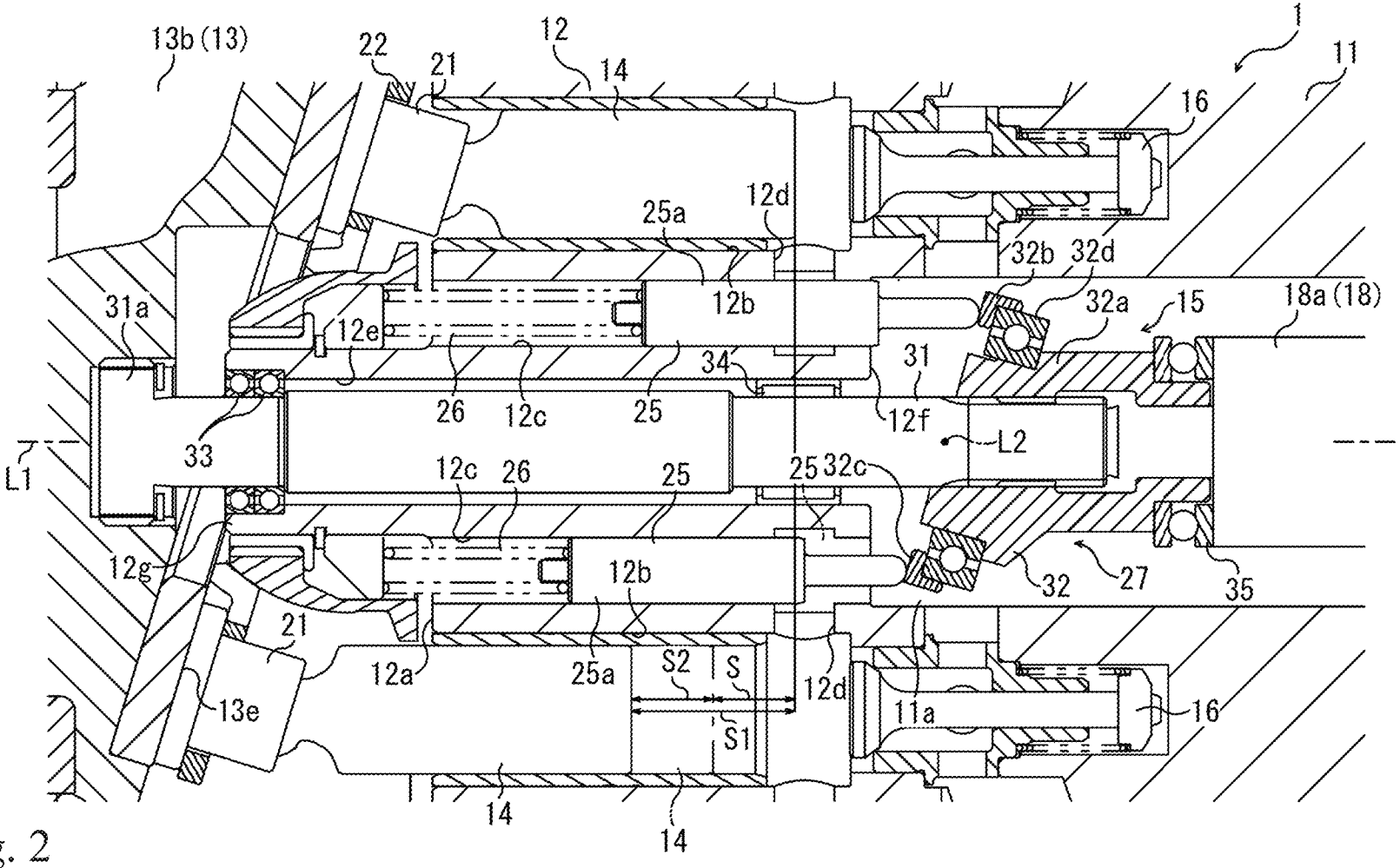
FIG. 2 is an enlarged cross-sectional view of a region X of the rotary swash plate hydraulic pump illustrated in FIG. 1.

The variable capacity mechanism 15 includes a plurality of spools 25, a plurality of springs 26, and a swash plate rotating shaft 27, as illustrated in FIG. 2. In the present embodiment, the variable capacity mechanism 15 includes the same number of spools 25 and springs 26 as the spool holes 12*c*, specifically, nine spools 25 and nine springs 26. The variable capacity mechanism 15 adjusts an effective stroke length S of each of the nine pistons 14. Thus, the variable capacity mechanism 15 can change the discharge capacity of the hydraulic pump 1. More specifically, the variable capacity mechanism 15 places the cylinder bore 12*b* in communication with the tank 19 via the spool hole 12*c* and the inlet passage 11*a* during the travel of the piston 14 at least from the bottom dead center to the top dead center (in other words, in the discharge process). Thus, the variable capacity mechanism 15 adjusts the effective stroke length S of each of the pistons 14.

<Spool>

The nine spools 25 are arranged corresponding to the cylinder bores 12*b*, respectively. The nine spools 25 reciprocate to open and close the paths between the corresponding cylinder bores 12*b* and the tank 19 (refer to FIG. 1). In the present embodiment, the nine spools 25 reciprocate to open and close the paths between the corresponding cylinder bores 12*b* and the inlet passage 11*a*. Furthermore, the nine spools 25 connect the corresponding cylinder bores 12*b* to the tank 19 via the inlet passage 11*a*. The spool 25 reciprocates in synchronization with the reciprocation of the piston 14 located in the corresponding cylinder bore 12*b* (hereinafter referred to as "the corresponding piston 14"). For example, when each of the spools 25 moves toward the bottom dead center of the corresponding piston 14, the spool 25 eventually opens the path between the corresponding cylinder bore 12*b* and the inlet passage 11*a*. On the other hand, when each of the spools 25 moves toward the top dead center of the corresponding piston 14, the spool 25 eventually closes the path between the corresponding cylinder bore 12*b* and the inlet passage 11*a*. Therefore, the spool 25 can connect the cylinder bore 12*b* to the tank 19 in the discharge process. The springs 26 are provided on the spools 25. The springs 26 bias the spools 25 toward a swash plate portion 32 to be described later.

<Swash Plate Rotating Shaft>

The swash plate rotating shaft 27 includes a shaft portion 31 and a swash plate portion 32. The swash plate rotating shaft 27 rotates in conjunction with the rotary swash plate 13. The swash plate rotating shaft 27 rotates to reciprocate each of the spools 25. Furthermore, the swash plate rotating shaft 27 can change the opening/closing position of each of the spools 25. The opening/closing position of each of the spools 25 is a position at which the spool 25 starts opening the communication passage 12*d* and a position at which the spool 25 starts closing the communication passage 12*d*.

The shaft portion 31 is inserted through the cylinder block 12. More specifically, the shaft portion 31 extends along the axis L1. The shaft portion 31 is inserted through the shaft insertion hole 12*e* of the cylinder block 12. The shaft portion 31 is pivotally supported at positions spaced apart in the axial direction in the shaft insertion hole 12*e*. More specifically, a third bearing 33 and a fourth bearing 34 are provided on the exterior of the shaft portion 31. The third bearing 33 and the fourth bearing 34 are spaced apart from each other in the axial direction on the shaft portion 31.

Two third bearings 33 are arranged in the axial direction on a leading end portion of the shaft portion 31 so as to prevent relative displacement thereof in the axial direction. The third bearings 33 fit on the projection 12*g* of the cylinder block 12. Thus, at the leading end portion, the shaft portion 31 is pivotally supported on the cylinder block 12 via the third bearings 33. The fourth bearing 34 is positioned on a middle portion of the shaft portion 31 so as to allow relative displacement thereof in the axial direction. More specifically, the fourth bearing 34 is positioned so as to allow relative displacement thereof on one side in the axial direction from the swash plate portion 32, which will be described in detail later, on the shaft portion 31. The fourth bearing 34 is positioned on the side of the other end 12*f* in the cylinder block 12. Thus, at the middle portion, the shaft portion 31 is pivotally supported on the cylinder block 12 via the fourth bearing 34.

The shaft portion 31 is in conjunction with the rotary swash plate 13. More specifically, one axial end portion 31*a* of the shaft portion 31 protrudes from the shaft insertion hole 12*e* toward the rotary swash plate 13. The one axial end portion 31*a* of the shaft portion 31 is detachably coupled to the rotary swash plate 13 so as to prevent relative rotation thereof. Therefore, the shaft portion 31 rotates about the axis L1 in conjunction with the rotary swash plate 13. In the present embodiment, the shaft portion 31 is splined or keyed to the rotary swash plate 13. Note that the shaft portion 31 may be coupled to the rotary swash plate 13 by a joint member or may be configured integrally with the rotary swash plate 13. The other axial end portion of the shaft portion 31 protrudes from the shaft insertion hole 12*e* toward the inlet passage 11*a*.

The swash plate portion 32 includes a base portion 32*a* and an abutment portion 32*b*. The swash plate portion 32 is provided on the shaft portion 13*a* so as to prevent relative rotation thereof. More specifically, the swash plate portion 32 is provided on the exterior of the other axial end portion of the shaft portion 31 so as to prevent relative rotation thereof. Therefore, the swash plate portion 32 is disposed on the shaft portion 31 so as to face the other end surface 12*f* of the cylinder bore 12*b* in the inlet passage 11*a*. The spool 25 biased by the spring 26 is in abutment with the swash plate portion 32. The swash plate portion 32 includes a swash plate rotating shaft-end inclined surface 32*c* to be described in detail later. Therefore, by the rotation of the swash plate rotating shaft 27, the swash plate portion 32 reciprocates each of the spools 25. In the present embodiment, the swash plate portion 32 causes the spool 25 to reciprocate in synchronization with the reciprocation of the corresponding piston 14. The swash plate portion 32 is provided on the shaft portion 13*a* so as to be movable back and forth in the axial direction. By moving back and forth in the axial direction, the swash plate portion 32 adjusts the opening/closing position of the spool 25.

The base portion 32*a* is provided on the shaft portion 31 so as to be movable back and forth in the axial direction and prevent relative rotation thereof. More specifically, the base portion 32*a* is provided on the exterior of the other axial end portion of the shaft portion 31 and keyed thereto so as to be movable back and forth and prevent relative rotation thereof. An axially middle portion of the base portion 32*a* is formed having a large diameter. The outer peripheral surface of the axially middle portion of the base portion 32*a* forms a cylindrical shape and has an axis tilted clockwise with respect to the rotation axis of the shaft portion 31. In the present embodiment, the rotation axis of the shaft portion 31 matches the axis L1.

The abutment portion 32*b* includes a swash plate rotating shaft-end inclined surface 32*c*. The abutment portion 32*b* is provided on the base portion 32*a*. More specifically, the abutment portion 32*b* is provided on the exterior of the axially middle portion of the base portion 32*a* via a fifth bearing 32*d*. The fifth bearing 32*d*, which is a radial bearing, is a ball bearing in the present embodiment. Note that the fifth bearing 32*d* is not limited to the radial bearing and may be a thrust bearing. A middle portion of the base portion 32*a* fits on the inner peripheral surface of the fifth bearing 32*d*. Thus, the fifth bearing 32*d* is provided on the exterior of a middle portion of the shaft portion 31 so that the axis of the fifth bearing 32*d* is tilted clockwise with respect to the rotation axis of the shaft portion 31. The fifth bearing 32*d* is disposed so that one axial end portion thereof faces the other end surface 12*f* of the valve block 12. The abutment portion 32*b* is attached to one axial end portion of the outer race of the fifth bearing 32*d*. More specifically, the abutment portion 32*b* is formed in the shape of a circular ring as well as having an L-shaped cross-section. The abutment portion 32*b* fits on the outside of the one axial end portion of the outer race of the fifth bearing 32*d*.

The swash plate rotating shaft-end inclined surface 32*c* is a portion of the abutment portion 32*b* that faces the other surface 12*f* of the cylinder block 12. The swash plate rotating shaft-end inclined surface 32*c* is inclined with respect to the rotation axis of the shaft portion 31. More specifically, the abutment portion 32*b* is provided on the exterior of the axially middle portion of the base portion 32*a* via the fifth bearing 32*d*, and thus the swash plate rotating shaft-end inclined surface 32*c* is inclined with respect to the rotation axis of the shaft portion 31. In the present embodiment, the swash plate rotating shaft-end inclined surface 32*c* is tilted in the same direction as the rotary swash plate-end inclined surface 13*e*, in other words, clockwise about a perpendicular axis L2 which is perpendicular to the rotation axis of the shaft portion 31. The nine spools 25 are in abutment with the swash plate rotating shaft-end inclined surface 32*c*. More specifically, the other axial ends of the nine spools 25 that are biased by the springs 26 are in abutment with the swash plate rotating shaft-end inclined surface 32*c*.

When the swash plate rotating shaft 27 rotates, the swash plate portion 32 causes the spool 25 to reciprocate in synchronization with the corresponding piston 14. More specifically, the swash plate rotating shaft 27 synchronizes the timings at which the spool 25 and the corresponding piston 14 are positioned at the dead centers. Thus, the swash plate rotating shaft 27 can place the cylinder bore 12*b* in communication with the inlet passage 11*a* when the corresponding piston 14 is located at the bottom dead center. On the other hand, the swash plate rotating shaft 27 can restrict the opening degree between the cylinder bore 12*b* and the inlet passage 11*a* and eventually close the path therebetween as the corresponding piston 14 travels from the bottom dead center toward the top dead center.

By moving back and forth, the swash plate portion 32 adjusts the opening/closing position of the spool 25. More specifically, by moving the base portion 32*a* relative to the shaft portion 31, the swash plate portion 32 moves back and forth relative to the other end surface 12*f* of the cylinder block 12. Thus, the dead center position of the spool 25 in the cylinder bore 12*b* can be changed. For example, when the swash plate portion 32 moves forward in one axial direction, the dead center position of the spool 25 in the cylinder bore 12*b* shifts in the one axial direction. On the other hand, when the swash plate portion 32 moves backward in the other axial direction, the dead center position of the spool 25 in the cylinder bore 12*b* shifts in the other axial direction. Therefore, the opening/closing position of the spool 25 in the cylinder bore 12*b* can be shifted in the axial direction.

The effective stroke length S of each of the pistons 14 is a range of stroke in which the working fluid can be discharged from the corresponding cylinder bore 12*b*. Specifically, the effective stroke length S is a value obtained by subtracting an open stroke length S2 from an actual stroke length S1. The actual stroke length S1 is the stroke length of actual travel (that is, the distance from the bottom dead center to the top dead center) of the piston 14. The open stroke length S2 is the stroke length of the piston 14 traveling from the bottom dead center until the communication passage 12*d* is closed; when the opening/closing position changes, the open stroke length S2 changes. Therefore, it is possible to adjust the effective stroke length S of each of the pistons 14 by moving the swash plate portion 32 back and forth. Thus, the discharge capacity of each of the cylinder bores 12*b* can be changed.

<Inlet-End Check Valve>

Each of the inlet-end check valves 16 is provided on a corresponding one of the cylinder bores 12*b*. This means that there are the same number of inlet-end check valves 16 as the cylinder bores 12*b*, specifically, nine inlet-end check valves 16, in the present embodiment. The inlet-end check valve 16 opens and closes the path between the cylinder bore 12*b* and the inlet passage 11*a*. More specifically, the inlet-end check valve 16 allows the flow of the working fluid from the inlet passage 11*a* to the cylinder bore 12*b* and blocks the opposite flow of the working fluid. Specifically, in the intake process in which the piston 14 moves from the top dead center to the bottom dead center, the working fluid flows from the inlet passage 11*a* to the cylinder bore 12*b*. On the other hand, in the discharge process, the flow of the working fluid from the inlet passage 11*a* to the cylinder bore 12*b* is stopped.

<Discharge-End Check Valve>

Each of the discharge-end check valves 17 is provided on a corresponding one of the cylinder bores 12*b*. In the present embodiment, each of the discharge-end check valves 17 is provided on a corresponding one of the passage portions 11*e* of the discharge passage 11*b*. This means that there are the same number of discharge-end check valves 17 as the passage portions 11*e*, in other words, as the cylinder bores 12*b*, specifically, nine discharge-end check valves 17, in the present embodiment. The discharge-end check valve 17 opens and closes the path between the cylinder bore 12*b* and the discharge port 11*d*. More specifically, the discharge-end check valve 17 allows the flow of the working fluid from the cylinder bore 12*b* to the discharge port 11*d* and blocks the opposite flow of the working fluid. When the hydraulic pressure of the cylinder bore 12*b* becomes greater than or equal to a predetermined set pressure, the discharge-end check valve 17 allows the flow of the working fluid from the cylinder bore 12*b* to the discharge port 11*d*. In other words, in the intake process, the flow of the working fluid from the cylinder bore 12*b* to the discharge port 11*d* is stopped. On the other hand, in the discharge process, the working fluid flows from the cylinder bore 12*b* to the discharge port 11*d*.

<Linear Motion Actuator>

The linear motion actuator 18 moves the swash plate portion 32 back and forth relative to the shaft portion 31. The linear motion actuator 18 is coupled to the swash plate portion 32 via a thrust bearing 35. More specifically, the linear motion actuator 18 includes a movable portion 18*a* that moves in the axial direction. The base portion 32*a* of the swash plate portion 32 is provided on the movable portion 18*a* via the thrust bearing 35. Therefore, the thrust bearing 35 reduces the transmission of the rotation of the swash plate portion 32 to the movable portion 18*a*. Note that the linear motion actuator 18 is not limited to an electrically driven actuator and may be a hydraulically driven actuator such as a hydraulic cylinder. The bearing that couples the linear motion actuator 18 and the swash plate portion 32 together may also be an angular ball bearing or a tapered roller bearing; it is sufficient that the bearing be capable of reducing the transmission of the rotation of the swash plate portion 32 to the linear motion actuator 18.

<Operation of Hydraulic Pump>

When the drive source rotatably drives the rotary swash plate 13, the hydraulic pump 1 operates as follows. Specifically, when the rotary swash plate 13 is rotatably driven, each of the pistons 14 reciprocates within the corresponding cylinder bore 12*b* accordingly. Thus, the piston 14 draws the working fluid from the inlet port 11*c* into the cylinder bore 12*b* via the inlet-end check valve 16 through the inlet passage 11*a* in the intake process. On the other hand, the piston 14 discharges the working fluid from the cylinder bore 12*b* to the discharge port 11*d* via the discharge-end check valve 17 in the discharge process.

Furthermore, in the hydraulic pump 1, the swash plate rotating shaft 27 rotates in conjunction with the rotation of the rotary swash plate 13. Thus, each of the spools 25 reciprocates within the corresponding spool hole 12*c* in synchronization with the corresponding piston 14. As a result, the communication passage 12*d* is opened midway through the intake process of the piston 14, and the communication passage 12*d* is closed midway through the discharge process of the piston 14 (refer to the piston 14 indicated by the dash-dot-dot-dash line in FIG. 2) (refer to the spool 25 indicated by the dash-dot-dot-dash line in FIG. 2). Thus, the cylinder bore 12*b* and the communication passage 12*d* are in communication until the communication passage 12*d* is closed (in other words, until the piston 14 travels the open stroke length S2) in the discharge process. Thus, the discharge of the working fluid from the cylinder bore 12*b* to the discharge port 11*d* is limited until the communication passage 12*d* is closed. Therefore, the effective stroke length S of each of the pistons 14 is less than the actual stroke length S1 by the open stroke length S2, and the hydraulic pump 1 discharges an amount of the working fluid that corresponds to the effective stroke length S.

Figure 3:
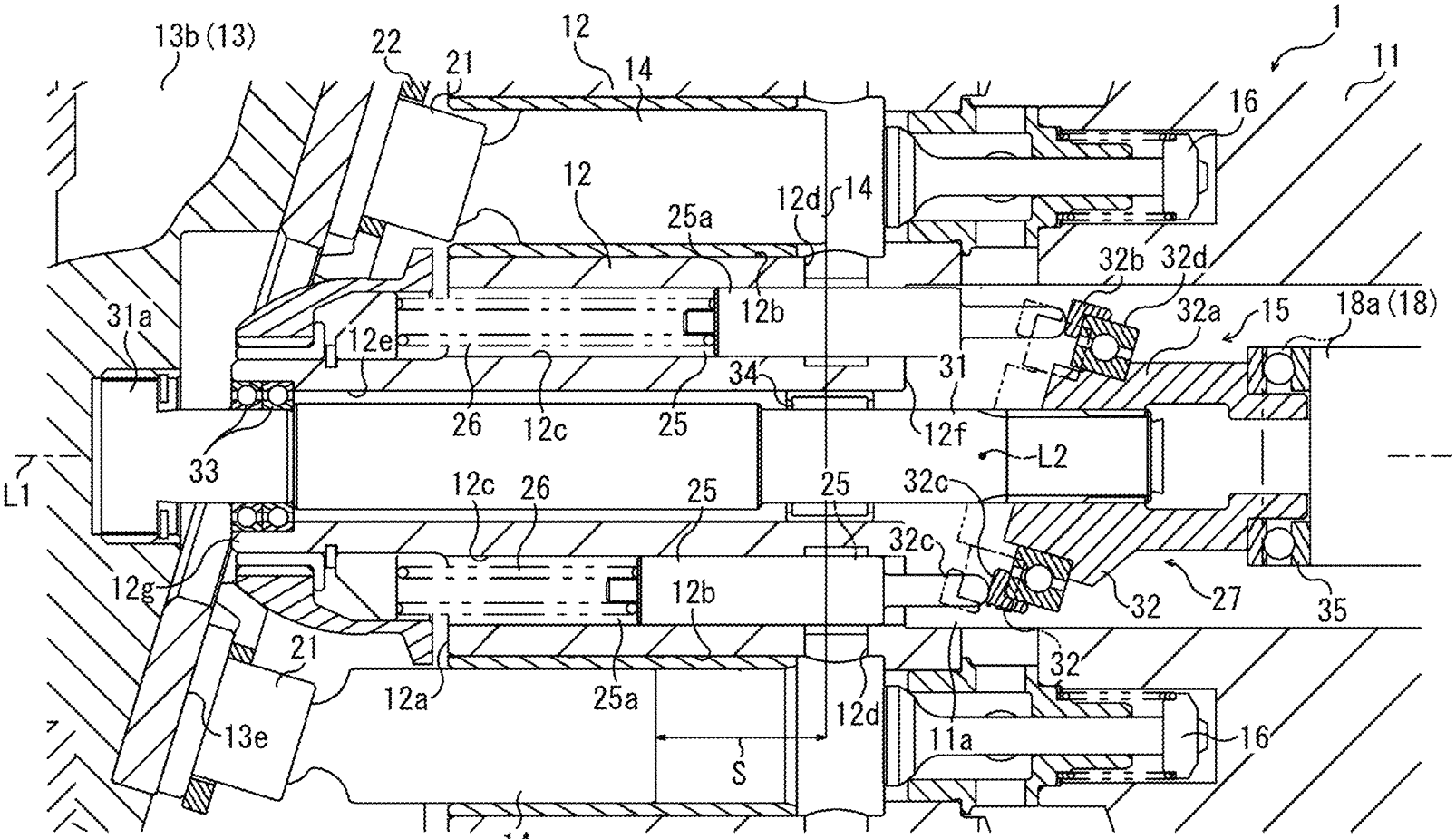
FIG. 3 is an enlarged cross-sectional view of the rotary swash plate hydraulic pump illustrated in FIG. 2 with a swash plate having moved back.

In the hydraulic pump 1, the linear motion actuator 18 moves the swash plate portion 32 in the axial direction. As a result, the effective stroke length S is changed. Specifically, when the linear motion actuator 18 moves the swash plate portion 32 back and forth (refer to the dash-dot-dot-dash line and the solid line in FIG. 3), a position at which each of the spools 25 and the swash plate portion 32 come into contact shifts in the one axial direction or the other axial direction. As a result, the opening/closing position of each of the spools 25 changes, and the open stroke length S2 of each of the pistons 14 changes. Thus, the effective stroke length S of each of the pistons 14 can be changed. Therefore, the discharge capacity of the hydraulic pump 1 is increased or decreased. Note that when the swash plate portion 32 moves backward as far as possible, as illustrated in FIG. 3, the open stroke length S2 of the piston 14 becomes zero. Therefore, the discharge capacity of the hydraulic pump 1 reaches the maximum.

In the hydraulic pump 1 according to the present embodiment, the shaft portion 31 is pivotally supported at positions spaced apart in the axial direction in the cylinder block 12. Therefore, the shaft portion 31 can rotate in a stable state. In other words, the swash plate portion 32 provided on the shaft portion 31 so as to prevent rotation thereof can also rotate in a stable state. Since the swash plate portion 32 rotates in a stable state while being driven to move back and forth in the axial direction, the effective stroke length S can be stably adjusted. Therefore, the discharge capacity can be accurately adjusted.

In the hydraulic pump 1 according to the present embodiment, the shaft portion 31 is detachably coupled to the rotary swash plate 13 so as to prevent relative rotation thereof. Therefore, the swash plate rotating shaft 27 easily moves in conjunction with the rotation of the rotary swash plate 13. Furthermore, since the shaft portion 31 can be attached to and detached from the rotary swash plate 13, assembling and disassembling of the hydraulic pump 1 is easy.

In the hydraulic pump 1 according to the present embodiment, the shaft portion 31 is splined or keyed to the rotary swash plate 13. Therefore, the shaft portion 31 can be easily attached to and detached from the rotary swash plate 13.

In the hydraulic pump 1 according to the present embodiment, the abutment portion 32*b* can rotate relative to the base portion 32*a*. It is possible to reduce the transmission of the rotational force from the base portion 32*a* to the abutment portion 32*b*. Therefore, the abutment portion 32*b* can be kept from rotating relative to the spool 25 upon reciprocation of the spool 25. Thus, it is possible to keep the spool 25 from sliding on the abutment portion 32*b*, meaning that wear of the abutment portion 32*b* can be reduced.

In the hydraulic pump 1 according to the present embodiment, the swash plate portion 32 is coupled to the linear motion actuator 18 via the thrust bearing 35. Therefore, it is possible to reduce the transmission of the rotation of the swash plate portion 32 to the linear portion actuator 18. Thus, the linear portion actuator 18 can move the rotating swash plate portion 32 back and forth.

In the hydraulic pump 1 according to the present embodiment, the rotary swash plate 13 is pivotally supported at two points that are the shaft portion 13*a* and the swash plate portion 13*b*, and thus it is possible to rotate the rotary swash plate 13 in a stable state. Thus, it is possible to keep the rotary swash plate 13 from wobbling. Therefore, the accuracy of the discharge capacity can be improved.

OTHER EMBODIMENTS

In the hydraulic pump 1 according to the present embodiment, the spool 25 in the variable capacity mechanism 15 may be configured as a valve body. When the spool 25 is a valve body, the valve body opens and closes the communication passage 12, for example. Furthermore, all the spools 25 are formed into the same shape, but the spools 25 may have different shapes. For example, round portions of the spools 25 may have different lengths. The number of pistons 14 and the number of spools 25 may be eight or less or may be ten or more. Furthermore, some of the plurality of spools 25 may be totally-enclosed spools that do not open the communication passage 12*d*. For example, three or nine spools 25 out of the nine spools 25 may be totally-enclosed spools. Moreover, the number of spools 25 does not need to be equal to the number of pistons 14 and may be less than the number of pistons 14. In this case, it is preferable that the number of spool holes 12*c* be substantially the same as the number of spools 25.

In the hydraulic pump 1 according to the present embodiment, the effective stroke length S of every piston 14 is adjusted, but it is sufficient that the effective stroke length S of at least one piston 14 be adjusted. Furthermore, in the hydraulic pump 1 according to the present embodiment, the communication passage 12*d* is connected to the tank 19 via the inlet passage 11*a*, but the communication passage 12*d* may be connected directly to the tank 19 or may be connected to the tank 19 via another passage or the like.

In the hydraulic pump 1 according to the present embodiment, the abutment portion 32*b* is provided so as to be rotatable relative to the base portion 32*a*, but the abutment portion 32*b* may be provided so as to prevent rotation thereof relative to the base portion 32*a*. Specifically, the abutment portion 32*b* may be fixed to the base portion 32*a* or may be formed integrally with the base portion 32*a*. Furthermore, the abutment portion 32*b* may be a portion of the outer race of the fifth bearing 32*d*. Moreover, the swash plate portion 32 may reciprocate with the spools 25 hooked thereon, for example, instead of abutting the spools 25.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

The invention claimed is:

1. A rotary swash plate hydraulic pump comprising:

a casing;

a cylinder block disposed in the casing so as to prevent relative rotation of the cylinder block and including a plurality of cylinder bores that are open on one end surface of the cylinder block;

a rotary swash plate rotatably housed in the casing so as to face the one end surface of the cylinder block;

a plurality of pistons each of which is inserted into a corresponding one of the plurality of cylinder bores and reciprocates within the corresponding one of the plurality of cylinder bores by rotation of the rotary swash plate;

a shaft portion that is inserted through the cylinder block and moves in conjunction with the rotary swash plate; and a swash plate portion provided on the shaft portion so as to be movable back and forth in an axial direction and prevent relative rotation of the swash plate portion, wherein the shaft portion is pivotally supported at positions spaced apart in the axial direction in the cylinder block, and at least one of the plurality of pistons has an effective stroke length variable according to movement of the swash plate portion.

2. The rotary swash plate hydraulic pump according to claim 1, wherein the shaft portion is detachably coupled to the rotary swash plate so as to prevent relative rotation of the shaft portion.

3. The rotary swash plate hydraulic pump according to claim 2, wherein the shaft portion is splined or keyed to the rotary swash plate.

4. The rotary swash plate hydraulic pump according to claim 1, wherein the swash plate portion includes: a base portion provided on the shaft portion so as to be movable back and forth in the axial direction and prevent relative rotation of the base portion; and an abutment portion that is provided on the base portion and abuts a plurality of spools, and the abutment portion includes a swash plate rotating shaft-end inclined surface that is inclined with respect to a rotation axis of the shaft portion and which the plurality of spools abut, the abutment portion being provided on the base portion so as to allow relative rotation of the abutment portion.

5. The rotary swash plate hydraulic pump according to claim 1, further comprising:

a linear motion actuator that moves the swash plate portion back and forth with respect to the shaft portion, wherein the linear motion actuator is coupled to the swash plate portion via a thrust bearing.

6. The rotary swash plate hydraulic pump according to claim 1, wherein the rotary swash plate includes: a shaft portion; and a swash plate portion that faces the one end surface of the cylinder block and rotates to reciprocate the plurality of pistons, the shaft portion is rotatably supported on the casing via a first bearing provided on an exterior of the shaft portion, and the swash plate portion is rotatably supported on the casing via a second bearing provided on an exterior of the swash plate portion.

* * * * *